US006348675B1

(12) United States Patent
Takagi

(10) Patent No.: US 6,348,675 B1
(45) Date of Patent: Feb. 19, 2002

(54) METHOD OF MANUFACTURING PLASTIC FILM WITH PORE-OPENING DISCHARGE SPARK CONTROL

(76) Inventor: Kazunari Takagi, No. 401 Sezar Kiyose, 16-14 Marsuyama 2-chome, Kiyose City, Tokyo (JP), 204-0022

( * ) Notice: Subject to any disclaimer, the term of this patent is extended or adjusted under 35 U.S.C. 154(b) by 0 days.

(21) Appl. No.: 09/485,305

(22) PCT Filed: Aug. 5, 1998

(86) PCT No.: PCT/GB98/02346

§ 371 Date: May 3, 2000

§ 102(e) Date: May 3, 2000

(87) PCT Pub. No.: WO99/07530

PCT Pub. Date: Feb. 18, 1999

(30) Foreign Application Priority Data

Aug. 5, 1997 (JP) ..... 9-223093

(51) Int. Cl.[7] ..... B26F 1/28; B26C 59/10

(52) U.S. Cl. ..... 219/384; 83/16

(58) Field of Search ..... 219/384; 162/114, 162/139, 192, 286; 156/252, 253, 380.7, 513; 83/16

(56) References Cited

U.S. PATENT DOCUMENTS

| | | | | | |
|---|---|---|---|---|---|
| 2,678,373 | A | * | 5/1954 | Suran | 219/384 |
| 3,622,751 | A | * | 11/1971 | Larive et al. | 219/384 |
| 4,219,727 | A | | 8/1980 | Bolt | |
| 4,247,754 | A | * | 1/1981 | Baier | 219/384 |
| 4,447,709 | A | | 5/1984 | Whitman, III | |
| 5,322,985 | A | * | 6/1994 | Ohba et al. | 219/384 |

FOREIGN PATENT DOCUMENTS

| | | |
|---|---|---|
| EP | 38 977 | 11/1991 |

* cited by examiner

*Primary Examiner*—John A. Jeffery
(74) *Attorney, Agent, or Firm*—Marshall, Gerstein, & Borun

(57) ABSTRACT

A method of producing plastics film (8) wherein high-voltage pulses are impressed between a pair of electrodes (4,6), thereby creating pores in a plastics film which is fed into the spark gap (5) between electrodes, characterised in that the number of discharge sparks which are generated subsequent to the pore-opening discharge spark is controlled by monitoring the pore-opening discharge spark and subsequent discharge sparks within one of the high-voltage pulses. The method produces fine pores having a uniform pore diameter under controlled circumstances.

2 Claims, 1 Drawing Sheet

METHOD OF MANUFACTURING PLASTIC FILM WITH PORE-OPENING DISCHARGE SPARK CONTROL

TECHNICAL FIELD

The invention relates to a method of manufacturing plastics film; more specifically, plastics film with fine pores of an uniform diameter by employing controlled high-voltage discharge sparks.

According to the use to which it is put, it is sometimes desirable for plastics film to have a certain degree of air permeability, and it is usual to select the material of which the film is made to have the desired air permeability. However, there are circumstances in which it is impossible to achieve the required degree of air permeability by virtue of the properties of the plastics film material itself. It also sometimes happens that a fixed thickness of film is required for reasons of strength, and this then makes it impossible to obtain the required degree of air permeability. In such cases it is known to create pores in the plastic film by mechanical, electrical, optical or other means. Of these methods, one which has been widely employed in recent years is that in which high-voltage pulses are applied on to the plastics film.

The conventional method of creating pores by means of high-voltage pulses involves running the plastics film between a pair of electrodes, the pores being created by applying high-voltage pulses between the electrodes so as to cause an electrical discharge. In this method, the pore diameter is controlled by the voltage of the high-voltage pulses and the length of time over which they are applied. However, because a plurality of discharge sparks is generated within the duration of one high-voltage pulse in order to create one pore, in the case of comparatively thick film, the discharge spark which creates the pore in the plastics film is generated only after several discharge sparks have been generated, which serve merely to cause the dielectric breakdown of the layer of air between the electrodes until such time as a pore is created in the film. This means that it is impossible to bring about uniform pore diameter simply by controlling the length of time over which the high-voltage pulse is applied. Moreover, the voltage of the high-voltage pulses which are applied between the electrodes is no greater than that which causes the dielectric breakdown of the layer of air between the electrodes and the plastics film. Thus, although the voltage needs to be higher than this, it has hitherto been impossible to control pore diameter by the voltage of the high-voltage pulses.

DESCRIPTION OF THE DRAWINGS

The invention will now be described by way of example with reference to the accompanying drawings in which.

DISCLOSURE OF THE INVENTION

It is the aim of the present invention to provide a method of manufacturing plastics film in which fine pores having a uniform pore diameter are formed under controlled circumstances.

The present invention is based on the discovery that by controlling the number of discharge sparks which are generated subsequent to the pore-opening discharge spark within one high-voltage pulse, it is possible to ensure that the diameter of the pores formed in the plastics film is even.

In particular, the present invention comprises: a method of manufacturing plastics film wherein high-voltage pulses are applied between a pair of electrodes, thereby creating pores in a plastics film fed into the spark gap between said electrodes, characterised in that the number of discharge sparks which are generated subsequent to a pore-opening discharge spark is controlled by monitoring the pore-opening discharge spark and subsequent discharge sparks within one of said high-voltage pulses.

Preferably, the pore-opening discharge spark and subsequent discharge sparks within one of the said high-voltage pulses are monitored by setting a threshold value S at $$B+(A-B)/3<S<B+2(A-B)/3$$

where A is the voltage drop at the time of a partial discharge spark of the electrode on the side of the spark gap on which the high-voltage pulse is applied, and B is the voltage drop at the time of a pore-opening discharge spark.

Also, the length of the spark gap is preferably 2–30 mm.

There is no particular restriction on the type of plastics film to which the present invention can be applied. Examples include semi-synthetic plastics films such as cellulose film, cellulose diacetate film and cellulose triacetate film, and synthetic plastics films represented by polyethylene film, polypropylene film, polystyrene film, vinyl polychloride film, vinylidene polychloride film, vinyl polyacetate film, polyvinyl alcohol film, nylon 6 film, nylon 66 film, polyester film, polycarbonate film, fluorine resin film and others. Moreover, the method to which the present invention pertains can be applied to single-layer plastics film made of one type of plastics only, to mixed plastic film made by combining two or more types of plastics, or to multilayer plastics film consisting of layers of two or more types of plastics. Multilayer plastics film can be produced by laminating single-layer film or by coextrusion.

There is no particular restriction on the thickness of plastics film to which the present invention can be applied, and by controlling the discharge voltage and other factors it is possible to create pores in a wide range of thicknesses of plastic film. Nevertheless, the plastics film is preferably 10–150 $\mu$m, and more particularly 20–70 $\mu$m thick.

There follows an explanation of the present invention with reference to the drawings.

Figure 1:
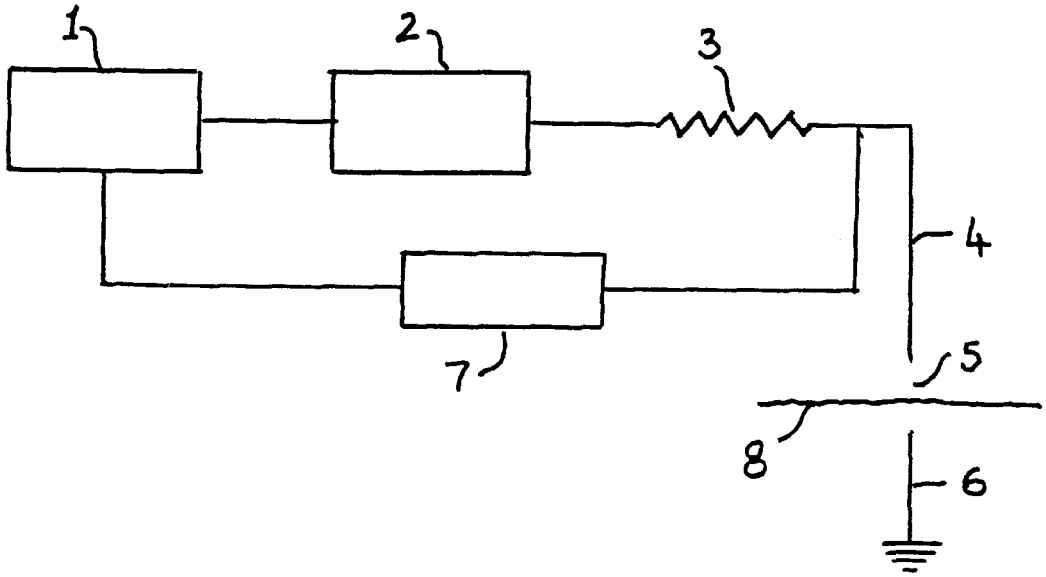
FIG. 1 is a schematic diagram of one method of manufacturing plastics film according to the invention.

In the apparatus illustrated in FIG. 1, a pulse generator 1, a high-voltage transformer 2, a resistance 3 and an upper electrode 4 are connected, and an earth electrode 6 is located on the other side of a spark gap 5 between it and the upper electrode. Between the resistance and the upper electrode there is a high-voltage probe (voltage divider) 7, which measures the voltage of the upper electrode and sends signals to the pulse generator. A plastics film 8 is fed into the spark gap by means of guide rollers.

Figure 2:
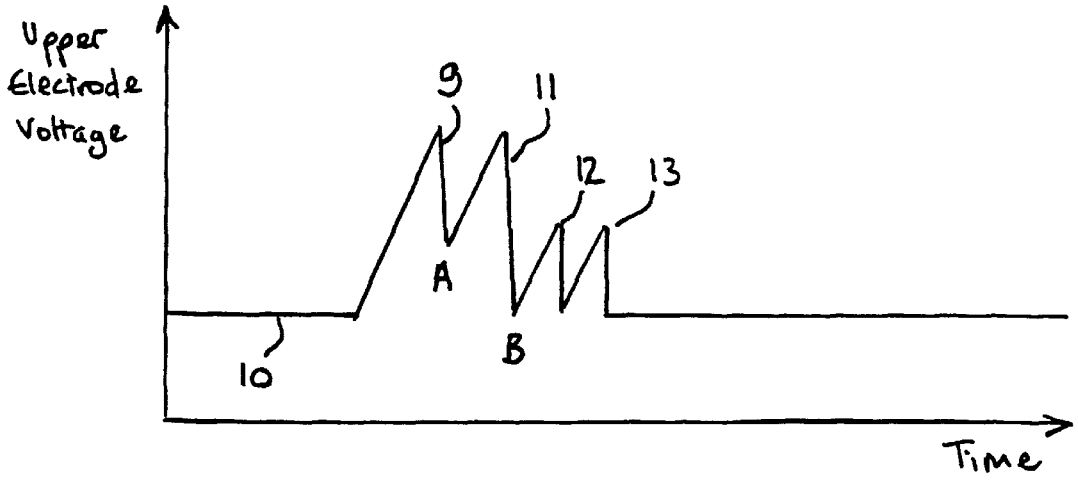
FIG. 2 is a schematic diagram of discharge voltages of the upper electrode of FIG. 1 using a high-voltage probe.

In the method of the present invention, high-voltage pulses wherein the voltage of pulses generated in the pulse generator 1 is increased by the high-voltage transformer 2, are employed in order to generate discharge sparks in the spark gap between the electrodes, thus creating pores in the plastics film 8. FIG. 2 is a schematic diagram of discharge voltages when the voltage of the upper electrode was measured using a high-voltage probe. In FIG. 2, the discharge spark which appears initially is a partial discharge spark 9, serving only to cause the dielectric breakdown of the layer of air in the spark gap. At the time of the partial discharge spark the voltage of the upper electrode does not drop as far as ground level 10. A pore-opening discharge spark 11 causes the dielectric breakdown of the plastic film and the layer of air in the spark gap in such a way that a pore is created in the plastics film by the said discharge spark, and the voltage of the upper electrode drops to ground level. Discharge sparks subsequent to the pore-opening discharge spark become penetrating discharge sparks 12, 13 and cross to the earth electrode 6 through the pore in the plastics film, with a consequent drop in discharge voltage in comparison with that of the pore-opening spark.

In this way, because there is a difference between the drop in the voltage of the upper electrode at the time of the pore-opening discharge spark in comparison with that which occurs at the time of a partial discharge spark, the pore-opening spark discharge is best monitored by measuring the voltage of the upper electrode by means of a high-voltage probe, then setting a threshold value S at $$B+(A-B)/3<S<B+2(A-B)/3$$

where A is the voltage drop at the time of a partial discharge spark of the electrode on the side of the spark gap on which the high-voltage pulse is impressed and B is the voltage drop at the time of a pore-opening discharge spark. The same holds true of monitoring the pore-opening discharge spark in relation to the penetrating discharge sparks which are generated subsequently to it.

The diameter of the pores created in the plastics film becomes steadily larger as the number of penetrating discharge sparks increases. Consequently, by cutting the pulse off at a point when the desired number of penetrating discharge sparks has been detected it becomes possible to consistently control the number of penetrating discharge sparks; and by ensuring that there is a constant number of penetrating discharge sparks, it becomes possible to produce pores of a uniform diameter.

The number of pores per electrode created in the plastics film is controlled by the frequency of the high-voltage pulse and the film speed. Consequently, by ensuring that the frequency of the high-voltage pulse follows the speed of the film, it is possible to produce a set number of pores even if the film speed changes.

In the present mode, it is possible to control the discharge voltage more precisely by means of the length of the spark gap. The shorter the spark gap is, the lower the penetrating discharge voltage becomes, with a consequent lessening of the amount by which the pore diameter is widened by one penetrating discharge spark. The longer the spark gap is, the higher the penetrating discharge voltage becomes, so that the amount by which the pore diameter is widened by one penetrating discharge spark increases. The length of the spark gap can be selected according to the material and thickness of the plastics film being processed and the desired pore diameter. However, it should normally be 2–30 mm, and preferably 2–20 mm. For instance, when creating pores with a diameter of around 50 μm in stretched polypropylene film with a thickness of 30 μm, the length of the spark gap is preferably about 10 mm.

There follow a number of examples whereby the present invention is described in greater detail. However, the present invention is in no way restricted to these examples.

EXAMPLE 1

Pores were created by electrical discharge in biaxially stretched polypropylene film 30 μm thick and 800 mm wide. The apparatus used consisted of four of the devices illustrated in FIG. 1, which were positioned at equal distances across the width of the film. The upper and earth electrodes were stainless-steel tubes 2 mm in diameter, and the spark gaps were set at 12 mm. The pulse voltage was 50 kV, pulse width 5 ms, frequency 50 Hz, and resistance 8 MW, and the number of penetrating discharge sparks was set at 0. Pores were created with the plastic film travelling at a speed of 50 m/min through the spark gap in such a way that it did not come into contact with the electrodes.

After the pores had been produced, the film was examined under a scanning electron microscope. Pore diameter was found to be 30–50 μm, and the number of pores per electrode in a one-metre length of film was 60.

EXAMPLE 2

The same operation as that of Example 1 was repeated, except that the number of penetrating discharge sparks was set at 2. After processing, pore diameter was 40–60 μm, and the number of pores per electrode in a one-metre length of film was 60.

Comparison

Pores were created by means of discharge sparks using the conventional method in which the voltage of the high-voltage pulses and the length of time over which they were applied was controlled without control of the number of penetrating discharge sparks.

The plastics film employed was biaxially stretched polypropylene film 30 μm thick and 800 mm wide as in Example 1. The length of the spark gaps was set at 12 mm, the pulse voltage at 50 kV, pulse width 5 ms, frequency 50 Hz, and resistance 8 MW. Pores were created with the plastic film travelling at a speed of 50 m/min through the spark gap in such a way that it did not come into contact with the electrodes.

After the pores had been processed, the film was examined under a scanning electron microscope. Pore diameter was found to be 70–200 μm, and the number of pores per electrode in a one-metre length of film was 60.

The results of Examples 1–2 and Comparison 1 are shown in Table 1.

TABLE 1

| | Example 1 | Example 2 | Comparison 1 |
|---|---|---|---|
| Processed film | Biaxially stretched polypropylene film | | |
| Film thickness (μm) | 30 | | |
| Pulse voltage (kV) | 50 | 50 | 50 |
| Pulse width (ms) | 5 | 5 | 5 |
| Frequency (Hz) | 50 | 50 | 50 |
| Resistance (MW) | 8 | 8 | 8 |
| Gap betweeen electrodes (mm) | 12 | 12 | 12 |
| Number of pore-penetrating discharge sparks | 0 | 2 | — |
| Pore size (μm) | 30–50 | 40–60 | 70–200 |
| Number of pores (per m electrode) | 60 | 60 | 60 |

A comparison of the results obtained in Examples 1 and 2 shows that altering the number of penetrating discharge sparks from 0 to 2 caused the pore diameter to increase from 30–50 μm to 40–60 μm. This proves that it is possible to control the pore diameter by varying the number of penetrating discharge sparks, and indeed to increase the pore diameter by increasing the number of penetrating discharge sparks. Moreover, the difference between minimum and maximum pore diameters in the films of Examples 1–2 was 20 μm, and pore diameter was uniform. In the film of Comparison 1, on the other hand, pore diameter was larger at 70–200 μm, and varied over a wide range.

EXAMPLE 3

Pores were created by electrical discharge in unstretched polypropylene film 30 μm thick and 800 mm wide. The apparatus used consisted of four of the devices illustrated in FIG. 1, which were positioned at equal distances across the width of the film. The upper and earth electrodes were stainless-steel tubes 2 mm in diameter, and the spark gaps were set at 7 mm. The pulse voltage was 50 kV, pulse width 5 ms, frequency 60 Hz, and resistance 8 MW, and the number of penetrating discharge sparks was set at 0. Pores were created with the plastics film travelling at a speed of 100 m/min through the spark gap in such a way that it did not come into contact with the electrodes.

After the pores had been processed, the film was examined under a scanning electron microscope. Pore diameter was found to be 20–40 μm, and the number of pores per electrode in a one-metre length of film was 36.

EXAMPLE 4

The same operation as that of Example 3 was repeated, except that the number of penetrating discharge sparks was set at 4. After processing, pore diameter was 40–60 μm, and the number of pores per electrode in a one-metre length of film was 36.

Comparison

Pores were created by means of discharge sparks using the conventional method whereby the voltage of the high-voltage pulses and the length of time over which they are impressed are controlled without control of the number of penetrating discharge sparks.

The plastics film employed was unstretched polypropylene film 30 μm thick and 800 mm wide as in Example 3. The length of the spark gaps was set at 7 mm, the pulse voltage was 50 kV, pulse width 5 ms, frequency 60 Hz, and resistance 8 MW. Pores were created with the plastic film travelling at a speed of 100 m/min through the spark gap in such a way that it did not come into contact with the electrodes.

After the pores had been processed, the film was examined under a scanning electron microscope. Pore diameter was found to be 50–100 μm, and the number of pores per electrode in a one-metre length of film was 36.

The results of Examples 3–4 and Comparison 2 are shown in Table 2.

TABLE 2

| | Example 3 | Example 4 | Comparison 2 |
|---|---|---|---|
| Processed film | Unstretched polypropylene film | | |
| Film thickness (μm) | 30 | | |
| Pulse voltage (kV) | 50 | 50 | 50 |

TABLE 2-continued

| | Example 3 | Example 4 | Comparison 2 |
|---|---|---|---|
| Pulse width (ms) | 5 | 5 | 5 |
| Frequency (Hz) | 60 | 60 | 60 |
| Resistance (MW) | 8 | 8 | 8 |
| Gap between electrodes (mm) | 7 | 7 | 7 |
| Number of pore-penetrating discharge sparks | 0 | 4 | — |
| Pore size (μm) | 20–40 | 40–60 | 50–100 |
| Number of pores (per m electrode) | 36 | 36 | 36 |

A comparison of the results obtained in Examples 3 and 4 shows that altering the number of penetrating discharge sparks from 0 to 4 caused the pore diameter to increase from 20–40 μm to 40–60 μm. This proves that it is possible to control the pore diameter by varying the number of penetrating discharge sparks, and to increase the pore diameter by increasing the number of penetrating discharge sparks. Moreover, the difference between minimum and maximum pore diameters in the films of Examples 3–4 was 20 μm, and pore diameter was uniform. In the film of Comparison 2, on the other hand, pore diameter was larger at 50–100 μm, and varied over a wide range.

The method of producing plastic film to which the present invention pertains makes it possible to produce plastics film with pores which have a uniform and finely controlled diameter, thus facilitating the production of plastic film which allows a controlled gas permeation rate.

What is claimed is:

1. A method of manufacturing plastics film wherein high-voltage pulses are applied between a pair of electrodes so as to create pores in a plastics film fed into the spark gap between said electrodes, wherein the number of discharge sparks which are generated subsequent to a pore-open discharge spark is controlled by monitoring the pore-opening discharge spark and subsequent discharge sparks within one of the high-voltage pulses by setting a threshold value S at $$B+(A-B)/3<S<B+2(A-B)/3$$

wherein A is the voltage drop at the time of a partial discharge spark of the electrode on the side of the spark gap to which the high-voltage pulse is applied and B is the voltage drop at the time of a pore-opening discharge spark.

2. A method as claimed in claim 1 wherein the length of the spark gap is 2 to 30 mm.

* * * * *